US005078527A

United States Patent [19]

Bell

[11] Patent Number: 5,078,527

[45] Date of Patent: Jan. 7, 1992

[54] METHOD AND APPLICATOR FOR EDGE APPLICATION OF LIQUID ADHESIVES

[75] Inventor: Barry L. Bell, Byron, Calif.

[73] Assignee: Orcon Corporation, Union City, Calif.

[21] Appl. No.: 697,516

[22] Filed: Apr. 29, 1991

[51] Int. Cl.[5] ..... B05C 1/16; B05C 1/06

[52] U.S. Cl. ..... 401/261; 401/263; 401/193; 401/266; 401/48; 401/262

[58] Field of Search ..... 401/48, 138, 139, 137, 401/193, 261, 262, 263, 265, 266, 267

[56] References Cited

U.S. PATENT DOCUMENTS

| | | | |
|---|---|---|---|
| 492,068 | 2/1893 | Underwood | 401/265 X |
| 807,887 | 12/1905 | Walker | 401/193 X |
| 1,846,711 | 2/1932 | Evensen | 401/137 |
| 1,875,426 | 9/1932 | Dillon | 401/139 |
| 1,890,599 | 12/1932 | Cobello | 401/263 |
| 2,772,432 | 12/1956 | Andreola | 401/263 |
| 3,041,655 | 7/1962 | Entler | 401/263 |
| 3,116,152 | 12/1963 | Smith | 401/266 X |
| 3,589,820 | 6/1971 | Ward | 401/48 |
| 3,830,573 | 8/1974 | Schwartzman | 401/193 |
| 4,613,396 | 9/1986 | Scarborough | 401/139 X |

FOREIGN PATENT DOCUMENTS

| | | | |
|---|---|---|---|
| 484169 | 8/1953 | Italy | 401/193 |
| 607657 | 9/1948 | United Kingdom | 401/193 |

*Primary Examiner*—Danton D. DeMille
*Attorney, Agent, or Firm*—Virginia S. Medlen

[57] ABSTRACT

An adhesive applicator is provided for applying liquid adhesive to the edge of thin, stiff material such as abutting edges of carpet. The adhesive applicator includes a liquid adhesive reservoir to which is attached an applicator cap having a vertical and horizontal guide surface, and an adhesive orifice located on the vertical surface at a predetermined height above the horizontal surface to deliver liquid adhesive at a predetermined distance above the horizontal surface. In use, the applicator is inverted, the material having an edge on which adhesive is to be applied is aligned so that the bottom of the material rests on the horizontal guide surface and the edge abuts the vertical guide surface, and the applicator cap is moved along the edge maintaining this alignment. The applicator cap can also include a captive closure cap for closing and opening the orifice as desired.

18 Claims, 1 Drawing Sheet

METHOD AND APPLICATOR FOR EDGE APPLICATION OF LIQUID ADHESIVES

This is a continuation of co-pending application Ser. No. 07/522,380 filed on May 11, 1990 (now abandoned).

FIELD OF THE INVENTION

The present invention relates generally to adhesive dispensing devices. More particularly, this invention relates to a method and apparatus for applying liquid adhesive along the abutting edge surface of a relatively thin, flat stiff material like carpet backing.

DISCUSSION OF THE PRIOR ART

In the installation of wall-to-wall carpet, it is often necessary to create seams and cut the carpet to fit the size of the room to be carpeted. When such cuts are made, it is desirable to apply adhesive to abutting edge surfaces of carpet backing to seal the cut edge to prevent the loss of fibers. The ideal point for the application of adhesive is along the edge of the backing at the point where the pile meets the backing. In such uses it is important that the adhesive be confined to the backing and not be spread on the carpet pile, where it can stain or form unsightly blemishes.

Adhesive applicators in general are well known and are presently used for coating the edges of the carpet pieces. See, for example, U.S. Pat. No. 3,589,820 to Ward. However, these existing applicators are time consuming and difficult to use because they do not align the edge surface to which adhesive is to be applied with the orifice on the adhesive applicator, and because they require the operator to apply a constant pressure to the applicator reservoir bottle in order to obtain a proper flow of adhesive. If the operator squeezes the reservoir bottle too hard, too much adhesive will be applied. If the operator does not squeeze the reservoir bottle hard enough, an insufficient amount of adhesive will be applied. Further, because alignment is difficult to achieve and maintain during adhesive application with conventional dispensers, the adhesive is often not properly located or spread. Finally, conventional dispensers have removable caps which are easily lost, and, when lost, will cause the unused adhesive in the bottle to dry and harden since the reservoir cannot be sealed without the cap.

Thus, the need exists for an adhesive applicator which can automatically align the edge of carpet backing with the orifice of the applicator, which automatically spreads the adhesive over the desired surface, which minimizes the need for the operator to apply pressure to the applicator reservoir, and which includes a captive closure button which cannot be removed and lost.

SUMMARY OF THE INVENTION

The present invention provides an apparatus for the controlled application of liquid adhesives to the edge surfaces of relatively flat, thin, stiff materials.

In one embodiment, the present invention provides an adhesive applicator for applying a liquid adhesive to an edge surface, the applicator having a liquid adhesive reservoir and an applicator cap, the applicator cap having a vertical guide surface including an orifice for aligning the orifice with the edge surface along the length of the edge surface, a second guide surface extending perpendicularly from the vertical guide surface for supporting a portion of the material including the edge on which adhesive is to be applied and for aligning the orifice with the edge at a distance from the bottom of the edge so that adhesive is applied at a predetermined height from the second guide surface.

In another embodiment, the present invention provides a liquid adhesive applicator cap capable of attachment to a bottle containing liquid adhesive, the applicator cap having an orifice positioned in a vertical guide surface for aligning the orifice with the edge surface along the length of the edge surface, a second guide surface extending perpendicularly from the vertical guide surface for supporting a portion of the material including the edge on which adhesive is to be applied and for aligning the orifice with the edge at a distance from the bottom of the edge so that adhesive is applied at a predetermined desired height from the second guide surface.

In yet another embodiment, a method is provided for applying liquid adhesive to the abutting edge of a relatively flat, thin, stiff material such as carpet backing.

In the various embodiments, the size of the orifice and the angle of the reservoir bottle are varied to optimize the flow of adhesive from the reservoir using the force of gravity, thus eliminating or minimizing the application of pressure to the sides of the reservoir. Further, the various embodiments may include a captive closure mechanism for opening and closing the applicator orifice and for providing tactile determination of whether the applicator is open or closed.

BRIEF DESCRIPTION OF THE DRAWINGS

A better understanding of the invention and its advantages will be apparent from the detailed description taken in conjunction with the accompanying drawings in which.

DETAILED DESCRIPTION OF THE INVENTION

Figure 1:
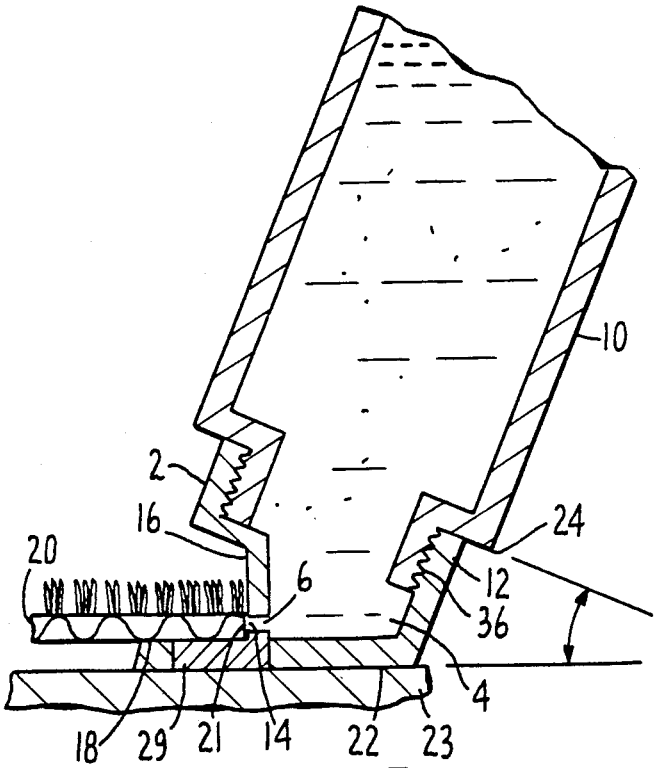
FIG. 1 is a cross-sectional side view of an adhesive applicator of the present invention.
Figure 2:
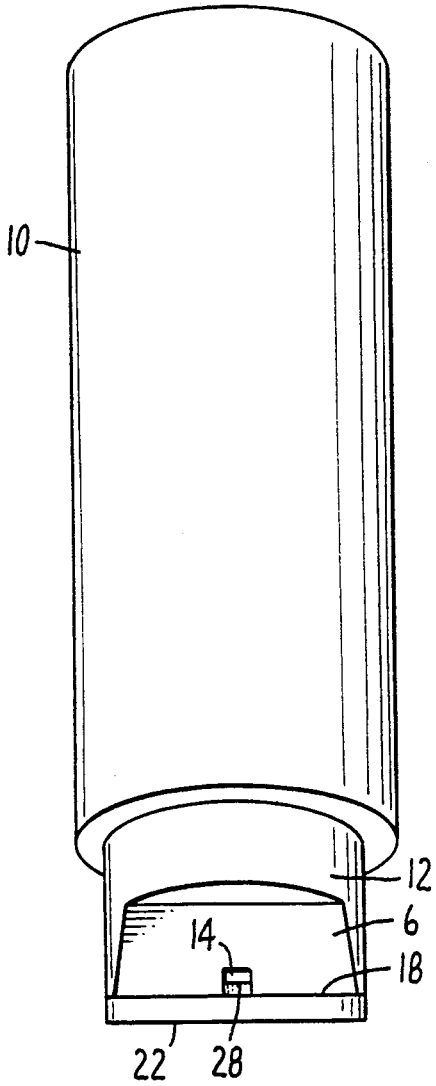
FIG. 2 is a front view of an adhesive applicator of the present invention.

FIGS. 1 and 2 show a typical adhesive applicator of the present invention. The applicator includes a reservoir 10 and an applicator cap 12. Reservoir 10 is preferably made from plastic or any other semi-rigid material suitable for holding a supply of the liquid adhesive to be applied. Reservoir 10 also preferably has a flat bottom to enable the adhesive applicator to be stored in a position with the reservoir 10 down and the applicator cap 12 up.

Applicator cap 12, which directs the flow of adhesive from reservoir 10, has an exterior 2, a generally hollow interior 4, and a conduit 6 which forms an adhesive orifice 14. Orifice 14 is located on vertical surface 16, which is a substantially flat, vertical surface for spreading the adhesive exiting the orifice and for aligning the adhesive orifice 14 with the length of the edge to be coated. Extending perpendicularly from vertical surface 16 is a substantially flat protruding lip 18 for supporting a portion of carpet backing 20, including the edge surface 21 on which adhesive is desired, and for aligning the edge surface 21 of carpet backing 20 with the adhesive orifice 14 along a distance from the bottom of the carpet backing.

Figure 3:
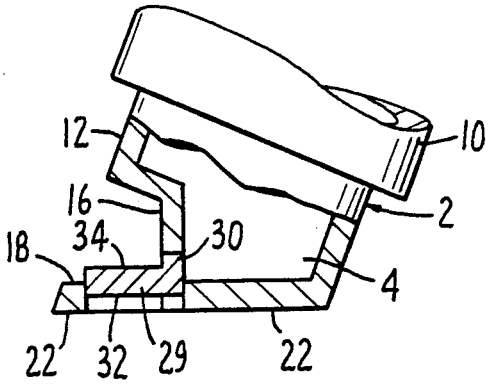
FIG. 3 is a cross-sectional side view of an adhesive applicator of the present invention.
Figure 4:
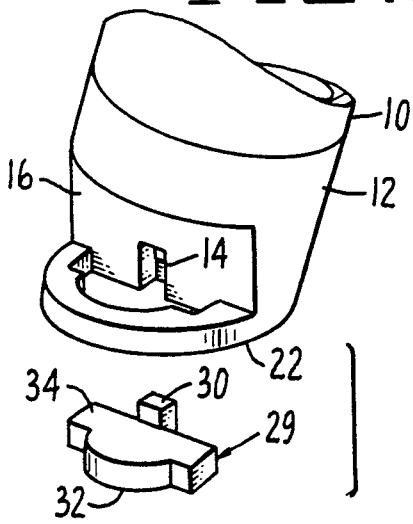
FIG. 4 is a perspective side view of an adhesive applicator cap of the present invention.

The applicator cap 12 is preferably constructed as shown inn FIGS. 1, 3 and 4 so that when the horizontal surface 22 is placed on a substantially flat surface 23, such as a floor, the angle $\alpha$ formed between the flat surface 233 and the shoulder 24 of reservoir 10 is about 23 degrees. Thus, the longitudinal axis of reservoir 10 is held at an angle of about 23 degrees from vertical. This feature, combined with the size of the orifice 14, as described in more detail below, permits a generally even flow of liquid adhesive onto the edge surface 21 of the carpet backing 20.

FIGS. 3–4 illustrate the applicator cap 12 in more detail. In the preferred embodiment, the orifice 14 is rectangular in shape, having a height of about 1/16 inch and a width of about ⅛ inch. The orifice 14 is preferably centered on the vertical surface 16 and the bottom 28 of orifice 14 is preferably located about ⅛ inch from the aligning surface 26 of lip 18. When used with multipurpose adhesives in seaming operations, such as, for example, a polyisoprene latex or polyvinyl emulsion type adhesives, the size of the orifice combined with the angle of the reservoir provides an optimal flow of liquid adhesive to the abutting edge surface 21 with little or no need for applying pressure to the adhesive reservoir 10. An operator may wish to apply pressure initially to start the flow of adhesive more quickly, and subsequently if the flow from orifice 14 becomes obstructed, for example, by a build up of partially solidified adhesive in or about the orifice, in order to clear the obstruction.

The interior 4 of applicator cap 12 is preferably provided with threads 36 for receiving mating threads on reservoir bottle 10 for attaching the applicator cap 12 to the reservoir 10. Most preferably, the threads in the interior of applicator cap 12 are oriented to hold the reservoir 10 at the desired angle from vertical when the applicator is inverted as shown in the drawings. One skilled in the art will response there are many possible alternative means of attaching the applicator cap 12 to the reservoir bottle 10.

Applicator cap 12 also preferably includes a captive closure button 29 for closing and opening orifice 14. Captive closure button 29 is attached to and inset between horizontal surface 22 and lip 18 and preferably includes a shut off stem 30 extending generally perpendicularly from the captive closure button 29 towards the orifice 14. While the adhesive applicator is in use, captive closure button 29 is in the "open" position in which the top 32 of captive closure button 29 is flush with horizontal surface 22 and the bottom 34 of captive closure button 29 is flush with the surface of lip 18, as shown in FIG. 1. When it is desired to stop the flow of adhesive through the orifice 14, the orifice 14 is closed by pushing against the top 32 of the captive closure button 29 to move it to the "closed" position. When the captive closure button 29 is in the "closed" position, the top 32 of captive closure button 29 is recessed within horizontal surface 22, the bottom 34 of captive closure button 29 projects from the surface of lip 18, and the stem 30 blocks the orifice 14, as shown in FIG. 3. When it is desired to open orifice 14 to restore the flow of adhesive, the operator pushes against the bottom 34 of captive closure button 29 until the bottom 34 of captive closure button 29 is flush with the surface of lip 18 as shown in FIG. 1. Thus, the operator can easily determine whether the adhesive applicator is open or closed simply by passing a finger over horizontal surface 22 to determine if the captive closure button 29 is flush or recessed or by passing a finger over lip 18 to determine if the captive closure button 29 is flush or protruding.

To use an adhesive applicator of the present invention, the operator attaches the applicator cap 12 to a reservoir bottle 10 containing a supply of adhesive. The applicator cap is inspected, the orifice is checked to make certain that it is unobstructed, and any old adhesive that has accumulated is removed. The position of the captive closure button 29 is checked and moved to the open position if necessary by pressing on the bottom 34 of the captive closure button 29 until the bottom 34 of the captive closure button 29 is flush with the surface of the lip 18 and the top surface 32 of the closure button 29 is flush with the horizontal surface 22. The applicator is then inverted, as shown in the drawings, so that the reservoir 10 is placed above the applicator cap 12, to enable gravity to act upon the liquid adhesive to cause the adhesive to flow into the hollow interior 4 of applicator cap 12, through conduit 6, and out of orifice 14. The lip 18 is placed under the carpet edge on which adhesive is desired so that the carpet backing 20 rests on lip 18 and the edge 21 on which adhesive is to placed abuts the vertical surface 16, placing the orifice 14 against the edge 21 of the backing 20. If the floor or other surface 38 being carpeted is substantially flat, horizontal surface 22 can be placed against the floor or other surface 38 during adhesive application. The applicator is then moved along the edge 21 in either direction with the backing 20 resting on lip 18 and the edge 21 abutting vertical surface 16 until the entire edge 21, or so much of edge 21 as the operator desires, is coated with adhesive. The lip 18 is then removed from underneath the carpet backing 20, the applicator is placed with the reservoir 10 down and the applicator cap 12 up to end the gravity flow of liquid adhesive, and the closure button 29 is moved to the closed position by pushing against the top 32 of closure button 29 until the top 32 is recessed within horizontal surface 22.

While the adhesive applicator of the present invention has been described herein as useful for coating abutting edge surfaces of carpets, it should also be noted that applicators of the present invention could be adapted to apply adhesive to the abutting edge surfaces of a variety of substantially flat, relatively stiff or rigid thin materials such as, for example, cardboard or plywood. The location of the orifice 14 in relation to lip 18 will depend upon the width of the material to be coated with adhesive and the desired point of application. The size of the orifice 14 will vary with the viscosity of the adhesive selected, increasing in size as viscosity increases and decreasing in size as viscosity decreases.

An adhesive applicator of the present invention provides many benefits over existing adhesive applicators. Because the edge on which adhesive is to be spread is automatically aligned with orifice 14 by lip 18 and vertical surface 16, operator error in alignment is eliminated and accidental misapplication of adhesive, for example on the pile rather than on the backing of carpeting, is avoided. Further, uneven application of adhesive caused by changes in the amount of pressure applied to the adhesive container by the operator is avoided because adhesive flows from the present invention with minimal need for operator-applied pressure and is immediately spread over the desired edge surface by the movement of the vertical guide surface over the edge of the material. Finally, loss of the closure cap is avoided, and a means of easily determining the open or closed state of the applicator is provided using the captive closure cap of the present invention.

One skilled in the art will recognize that it would be possible to construct the elements of the present invention from a variety of materials and to modify the placement of the components in a variety of ways. While the preferred embodiments have been described in detail and shown in the accompanying drawings, it will be evident that various further modifications are possible without departing from the scope of the invention as embodied in the claims.

I claim:

1. A liquid adhesive applicator for accurately applying adhesive along an edge of a relatively flat, thin, stiff material having a bottom portion and a top portion, comprising:

a reservoir for liquid adhesive, said reservoir having an opening of sufficient size to permit the gravity flow of liquid adhesive from the reservoir when the reservoir is positioned above the opening, and a longitudinal axis;

an applicator cap having an exterior and a generally hollow interior, a rigid, substantially flat vertical guide surface on the exterior of said cap for guiding the applicator cap along an edge of a relatively flat, thin, stiff material, a conduit passing through said cap from the interior to the exterior, said conduit forming an orifice on the vertical guide surface, a projecting lip extending perpendicularly from said vertical guide surface, said projecting lip having a rigid, substantially flat top surface and a bottom surface, said top surface for supporting a part of the material including the edge, said top surface being positioned slightly below the orifice so as to spread adhesive only on the bottom portion of the edge and, a means for attaching said applicator cap to said reservoir opening and for holding said longitudinal axis of said reservoir at an angle greater than about 90 degrees and less than about 180 degrees relative to said top surface of said projecting lip.

2. The applicator of claim 1 in which said applicator cap additionally has a means for closing said orifice when said orifice is open and for opening said orifice when said orifice is closed.

3. The applicator of claim 1 in which said orifice is located approximately ⅛ inch above the top surface of said projecting lip.

4. The applicator of claim 3 in which said orifice is about 1/16 inches high by about ⅛ inches wide.

5. The applicator of claim 1 in which said angle is about 23 degrees from vertical.

6. The applicator of claim 1 in which said means for attaching said applicator cap to said reservoir opening is mating threads on said applicator cap and on said reservoir.

7. An applicator cap for applying liquid adhesive to an edge of a relatively flat, thin, stiff material, the edge having a bottom portion and a top portion, said applicator cap comprising:

a generally hollow cap having an interior and an exterior;

a rigid, substantially flat vertical guide surface on the exterior of said cap for guiding the applicator cap along the length of the edge;

a conduit passing through said cap from the interior to the exterior, said conduit forming an orifice on the vertical guide surface;

a projecting lip extending perpendicularly from said vertical guide surface, said projecting lip having a rigid, substantially flat top surface and a bottom surface, said top surface forming a horizontal guide surface for supporting a part of the material including an edge and for aligning the bottom portion of the edge with said orifice;

a cap closure means for selectively closing and opening said orifice; and, a means for attaching said cap to an opening in a liquid adhesive reservoir and for holding a longitudinal axis passing through an opening in a liquid adhesive reservoir at an angle greater than about 90 degrees and less than about 180 degrees relative to said top surface of said projecting lip.

8. The applicator cap of claim 7 in which said orifice is located approximately ⅛ inch above the top surface of said projecting lip.

9. The applicator cap of claim 8 in which said orifice is about 1/16 inches high by about ⅛ inches wide.

10. The applicator cap of claim 7 in which said means for attaching said applicator cap to said reservoir comprises threads on the interior of said cap adapted to receive mating threads on said reservoir.

11. The applicator cap of claim 7 in which said angle is about 113 degrees.

12. A method for applying liquid adhesive to an edge of relatively thin, flat, stiff material using an adhesive applicator having a reservoir containing liquid adhesive and an applicator cap attached to said reservoir, said application cap having an exterior and a generally hollow interior, a vertical guide surface on the exterior of said cap for guiding the applicator cap along the length of the edge with the edge abutting the vertical guide surface, a conduit passing through said cap from the interior to the exterior, said conduit forming an orifice on the vertical guide surface, a projecting lip extending perpendicularly from said vertical guide surface, said projecting lip having a top surface and a bottom surface, said top surface for supporting a portion of said material including said edge and for aligning said edge with said orifice when said edge abuts said vertical guide surface, a closure button contained within said projecting lip on said applicator cap, said closure button having a first surface, a second surface, and a stem for blocking said orifice attached to said closure button perpendicular to and extending from said first surface, said closure cap capable of moving between an open and a closed position, said open position being when said first surface of said closure button is flush with said top surface of said projecting lip, said second surface of said closure button is flush with said bottom surface of said projecting lip, and said stem does not block said orifice, and said closed position being when said first surface of said closure button projects from said top surface of said projecting lip, said second surface of said closure button is recessed within said bottom surface of said projecting lip, and said stem blocks said orifice; said method comprising the steps of:

checking the position of the closure button, and if the closure button is in the closed position, moving the closure button to the open position by pushing the first surface of the closure button until said first surface is flush with the top surface of the projecting lip;

inverting the applicator so that the reservoir is positioned above the applicator cap;

placing the projecting lip under the material so that the projecting lip supports a portion of the material including the edge and the edge abuts the vertical guide surface;

moving the applicator along the edge with the edge abutting the vertical support surface until a desired length of the edge is coated with adhesive;

removing the projecting lip from under the material and placing the adhesive applicator in a position in which the reservoir is beneath the applicator cap;

moving the closure button to the closed position by pushing on the second surface of the closure button until the second surface is recessed within the bottom surface of the projecting lip and the stem blocks the orifice.

13. A method for applying liquid adhesive to an edge of carpet, said edge having a bottom portion of carpet backing and a top portion of carpet pile, so that adhesive is applied only to the bottom portion of the edge comprising carpet backing, using an adhesive applicator having a reservoir containing liquid adhesive and an applicator cap attached to an opening in said reservoir, said applicator cap having an exterior and a generally hollow interior, a vertical guide surface on the exterior of said cap for guiding the applicator cap along the edge of the carpet, a conduit passing through said cap from the interior to the exterior, said conduit forming an orifice on the vertical guide surface, a projecting lip extending perpendicularly from said vertical guide surface, said projecting lip having a horizontal guide surface for supporting a portion of said carpet including said edge and positioned with respect to said orifice to align the bottom portion of the edge with said orifice, and a closure button for closing said orifice, the reservoir opening including a longitudinal axis passing through the opening, the longitudinal axis being held by the applicator cap at an angle between vertical and horizontal relative to said horizontal guide surface of said projecting lip, said method comprising the steps of:

opening the orifice by moving the closure button away from the orifice;

orienting the applicator so that the reservoir is positioned above the applicator cap;

placing the projecting lip under the edge of the carpet so that the horizontal guide surface supports a part of the carpet including the edge and the edge abuts the vertical guide surface, aligning the orifice with the bottom portion of the edge;

moving the applicator along the carpet edge with the carpet edge abutting the vertical support surface until a desired length of the bottom portion of the carpet edge is coated with adhesive, and, removing the applicator from the carpet edge.

14. A liquid adhesive applicator for accurately applying a liquid adhesive along an edge of carpet, the edge having a bottom portion of carpet backing and a top portion of carpet pile, so that only the bottom portion of the edge comprising carpet backing is coated with the liquid adhesive, said carpet having a bottom surface and a top surface, said applicator comprising:

a reservoir for liquid adhesive having an opening of sufficient size to permit the gravity flow of liquid adhesive from the reservoir when the reservoir is positioned above the opening;

an applicator cap having:

an exterior, a generally hollow interior, a vertical guide surface on the exterior of said cap for guiding the applicator cap along an edge of carpet, a projecting lip extending perpendicularly from said vertical guide surface, said projecting lip having a horizontal guide surface for supporting a part of the carpet including an edge, a conduit passing through said cap from the interior to the exterior, said conduit forming an orifice on the vertical guide surface, said orifice positioned slightly above the horizontal guide surface for spreading adhesive only on the bottom portion of an edge of carpet, a closure button for selectively blocking and unblocking the orifice, and, a means for attaching the cap over the opening of the reservoir and for positioning the reservoir above the opening relative to the horizontal guide surface of the cap.

15. The applicator of claim 14 in which said means for attaching said applicator cap over said opening in said reservoir is mating threads on said applicator cap and on said reservoir.

16. The applicator of claim 15 in which said reservoir opening includes a longitudinal axis passing through the opening and in which said applicator cap threads are disposed within the cap to hold the longitudinal axis at an angle between vertical and horizontal relative to said horizontal guide surface of said projecting lip.

17. A liquid adhesive applicator for applying adhesive along an edge of a relatively flat, thin, stiff material having a bottom portion and a top portion so that only the bottom portion of said edge is coated with adhesive, said applicator comprising:

a reservoir for liquid adhesive having an opening of sufficient size to permit the gravity flow of liquid adhesive from the reservoir when the reservoir is positioned above the opening;

an applicator cap attached to said reservoir opening, said applicator cap having an exterior and a generally hollow interior, a rigid, substantially flat vertical guide surface on the exterior of said cap for guiding the applicator cap along the length of the edge with the edge abutting the vertical guide surface, a conduit passing through said button from the interior to the exterior, said conduit forming an orifice on the vertical guide surface, a projecting lip extending perpendicularly from said vertical guide surface, said projecting lip having a rigid, substantially flat top surface and a bottom surface, said top surface for supporting a portion of said material including said edge, said top surface being positioned slightly below the orifice so as to spread adhesive only on the bottom portion of the edge when said material is supported on said projecting lip and said edge abuts said orifice, and a closure button contained within said projecting lip on said applicator cap for selectively closing and opening the orifice, said closure button having a first surface, a second surface, and a stem for blocking said orifice attached to said closure button perpendicular to and extending from said first surface, said closure cap capable of moving between an open and a closed position, said open position being when said first surface of said closure button is flush with said top surface of said projecting lip, said second surface of said closure button is flush with said bottom surface of said projecting lip, and said stem does not block said orifice, and said closed position being when said first surface of said closure button projects from said top surface of said projecting lip, said second surface of said closure button is recessed within said bottom surface of said projecting lip, and said stem blocks said orifice.

18. An applicator cap for applying liquid adhesive to an edge of a relatively flat, thin, stiff material having a bottom portion and a top portion so that only the bottom portion of the edge is coated with adhesive, said applicator cap comprising:

a generally hollow cap having an interior and an exterior;

a means for attaching said cap to a liquid adhesive reservoir;

a rigid, substantially flat vertical guide surface on the exterior of said cap for guiding the applicator cap along the length of the edge when the edge abuts the vertical guide surface;

a conduit passing through said cap from the interior to the exterior, said conduit forming an orifice on the vertical guide surface;

a projecting lip extending perpendicularly from said vertical guide surface, said projecting lip having a rigid, substantially flat top surface and a bottom surface, said top surface forming a horizontal guide surface for supporting a portion of said material including said edge and for aligning the bottom portion of said edge with said orifice when said edge abuts said vertical guide surface; and, a cap closure means for selectively closing and opening said orifice, said cap closure means comprising a closure button contained with said projecting lip on said applicator cap, said closure button having a first surface, a second surface, and a stem for blocking said orifice attached to said closure button perpendicular to and extending from said first surface, said closure button capable of moving between an open and a closed position, said open position being when said first surface of said closure button is flush with said top surface of said projecting lip, said second surface of said closure button is flush with said bottom surface of said projecting lip, and said stem does not block said orifice, and said closed position being when said first surface of said closure button projects from said top surface of said projecting lip, said second surface of said closure button is recessed within said bottom surface of said projecting lip, and said stem blocks said orifice.

* * * * *